US010767340B2

(12) United States Patent
Amaya et al.

(10) Patent No.: US 10,767,340 B2
(45) Date of Patent: Sep. 8, 2020

(54) REINFORCEMENT STRUCTURE FOR BOOM OF WORK MACHINE

(71) Applicant: Caterpillar SARL, Geneva (CH)

(72) Inventors: Toru Amaya, Tokyo (JP); Masahiro Yamada, Tokyo (JP)

(73) Assignee: Caterpillar SARL, Geneva (CH)

( * ) Notice: Subject to any disclaimer, the term of this patent is extended or adjusted under 35 U.S.C. 154(b) by 327 days.

(21) Appl. No.: 15/739,456

(22) PCT Filed: Jun. 26, 2016

(86) PCT No.: PCT/EP2016/064590
§ 371 (c)(1),
(2) Date: Dec. 22, 2017

(87) PCT Pub. No.: WO2017/001287
PCT Pub. Date: Jan. 5, 2017

(65) Prior Publication Data

US 2018/0187393 A1 Jul. 5, 2018

(30) Foreign Application Priority Data

Jun. 29, 2015 (JP) ..... 2015-130123

(51) Int. Cl.

| | |
|---|---|
| ***E02F 3/38*** | (2006.01) |
| ***B66C 23/70*** | (2006.01) |
| ***E02F 3/32*** | (2006.01) |
| ***E02F 9/22*** | (2006.01) |
| *E02F 3/36* | (2006.01) |

(52) U.S. Cl.
CPC ..... *E02F 3/38* (2013.01); *B66C 23/702* (2013.01); *E02F 3/32* (2013.01); *E02F 9/2264* (2013.01); *E02F 3/369* (2013.01); *E02F 3/3622* (2013.01)

(58) Field of Classification Search
CPC ... E02F 3/38; E02F 3/32; E02F 9/2264; E02F 3/3622; E02F 3/369; B66C 23/702
See application file for complete search history.

(56) References Cited

U.S. PATENT DOCUMENTS

| | | | | |
|---|---|---|---|---|
| 4,392,314 A * | 7/1983 | Albrecht | ..... | E02F 3/38 29/463 |
| 2010/0119344 A1* | 5/2010 | Nabata | ..... | E02F 3/38 414/722 |
| 2015/0003949 A1* | 1/2015 | Kusama | ..... | E02F 3/38 414/722 |

FOREIGN PATENT DOCUMENTS

| | | |
|---|---|---|
| CN | 104250985 B | 6/2017 |
| JP | 3508795 B2 | 3/1997 |
| JP | H0978621 A | 3/1997 |
| JP | H09165773 A | 6/1997 |
| JP | 2002348903 A | 12/2002 |

(Continued)

*Primary Examiner* — Michael S Lowe

(57) ABSTRACT

A reinforcement structure that reinforces a boom of a work machine having a top plate, a pair of side plates, and a bottom plate forming an inner space therebetween. The plates are configured to form a curved portion at the middle of the boom along the longitudinal direction. The structure comprises a baffle disposed inside the boom rearward of the curved portion across the inner space. The baffle is a plate laterally bent so as to have a convex shape extending forward in the longitudinal direction. The reinforcement structure helps prevent twisting of the boom while dispersing stress concentrations in rear upper portions of the side plates compare to conventional flat baffle plates.

14 Claims, 4 Drawing Sheets

(56) References Cited

FOREIGN PATENT DOCUMENTS

| | | | |
|---|---|---|---|
| JP | 201443751 | | 3/2014 |
| JP | 2015010386 | A | 1/2015 |
| JP | 2015094129 | A | 5/2015 |

* cited by examiner

REINFORCEMENT STRUCTURE FOR BOOM OF WORK MACHINE

CROSS-REFERENCE TO RELATED APPLICATIONS

This application is a national phase application of International Patent Application No. PCT/EP2016/064590 filed Jun. 23, 2016, which claims priority to Japanese Patent Application No. 2015-130123 filed Jun. 29, 2015, both of which are incorporated by reference herein in their entireties for all purposes.

TECHNICAL FIELD

The present invention relates to a reinforcement structure for a boom of a work machine, which is provided with a baffle for reinforcement in an internal space of the boom.

BACKGROUND ART

There are many types of work machines which have a front boom as a component, as exemplified by hydraulic shovels.

The boom is often curved in the longitudinal direction and configured with a top plate forming an upper surface, a pair of side plates forming side surfaces, a bottom plate forming a lower surface, and a baffle. The baffle is a reinforcing wall provided to partition an internal space having the top plate, side plates and bottom plate as the peripheral walls and is welded to the inner wall surfaces of the top plate, the side plates and the bottom plate.

Japanese Patent Application Laid-open No. 2002-348903 discloses a boom structure capable of reducing torsional stress. This boom structure simulates a reference line that connects one end portion positioned on the boom base end side in a first bracket for fitting a boom cylinder attached to the bottom surface of the boom, and the center of curvature of a middle curved portion of the boom, wherein a lower reinforcing wall that is fixed to the bottom surface at one end portion is positioned in such a manner that a flange portion of the lower reinforcing wall approaching a top surface is inclined away from the reference line at the boom base end side. In this manner, the torsional stress occurring at a tip end portion of the reinforcing wall is reduced. The disclosed boom structure serves to reduce the torsional stress that occurs in the reinforcing wall and is not designed to prevent the stress from concentrating on the rear upper portions of the side plates.

When longitudinal bending, lateral bending, and twisting are made multiple times in the entire boom, high stress occurs in the boom. This stress tends to concentrate on the part where the baffle in the internal space of the boom and each of the plates (the top plate, the side plates, and the bottom plate) are welded together. The stress tends to concentrate especially on the top plate side of the welded parts between the rear side baffle and side plates, i.e., the rear upper portions of the side plates.

Such concentration of the stress can be prevented and handled by improving the strength of the reinforcement structure by increasing the plate thickness of the side plates and/or the baffle, but it unfavorably leads to significant increases in weight and cost.

The present invention was contrived in view of the foregoing problems, and an object thereof is to provide a reinforcement structure for a boom of a work machine, capable of preventing the stress from concentrating on the rear upper portions of the side plates while preventing the increases in weight and cost.

SUMMARY OF THE INVENTION (1) In order to achieve the foregoing object, a reinforcement structure for a boom of a work machine according to the present invention is a reinforcement structure for a boom of a work machine, which reinforces the boom configured with a top plate, a side plate, and a bottom plate and having an internal space and a curved portion in the middle in a longitudinal direction, wherein a baffle for reinforcement is provided further on a rear side than the curved portion in such a manner as to cut across the internal space, and the baffle is configured with a plate that curves vertically and protrudes forward.

(2) It is preferred that the baffle be symmetrical with respect to a centerline of the side plate.

According to the reinforcement structure for a boom of a work machine of the present invention, stress can be dispersed by configuring the baffle with a plate that curves vertically and protrudes forward, preventing the stress from concentrating on the rear upper portions of the side plates while preventing the increases in weight and cost.

The rear upper portion of the side plate described in the present invention represents a region near an upper slewing body (rear) with respect to the curved portion of the side plate, and a part of the side plate near the top plate (upper portion), the region including "a joint portion near the top plate, inside a joint portion between the side plate and the baffle at the rear of the curved portion."

DESCRIPTION OF EMBODIMENTS

Embodiments of the present invention are now described hereinafter with reference to the drawings.

Each of the embodiments illustrated below is merely an example and is not intended to exclude applications of various modifications and techniques that are not illustrated in the following embodiments. The configurations of the following embodiments can be implemented in various different ways without departing from the gist thereof, and can also be sorted out as needed or can be combined as appropriate.

The following embodiments each illustrate an example in which the present invention is applied to a hydraulic shovel functioning as a work machine, but the invention can be applied to various work machines across the board other than hydraulic shovels, such as hydraulic cranes.

In the following description, unless otherwise specified, the direction of travel of a work vehicle indicates the front, the left-hand side and the right-hand side are defined based on the front, the direction of gravity indicates the lower side, and the opposite direction indicates the upper side. In addition, in the descriptions of the devices and parts mounted in the work vehicle, unless otherwise specified, the vertical direction, the lateral direction (also referred to as "width direction," hereinafter), and the longitudinal direction are defined based on the state in which these devices and parts are mounted in the work vehicle.

The configuration of a hydraulic shovel 1 according to an embodiment of the present invention is described with reference to FIG. 1.

Figure 1:
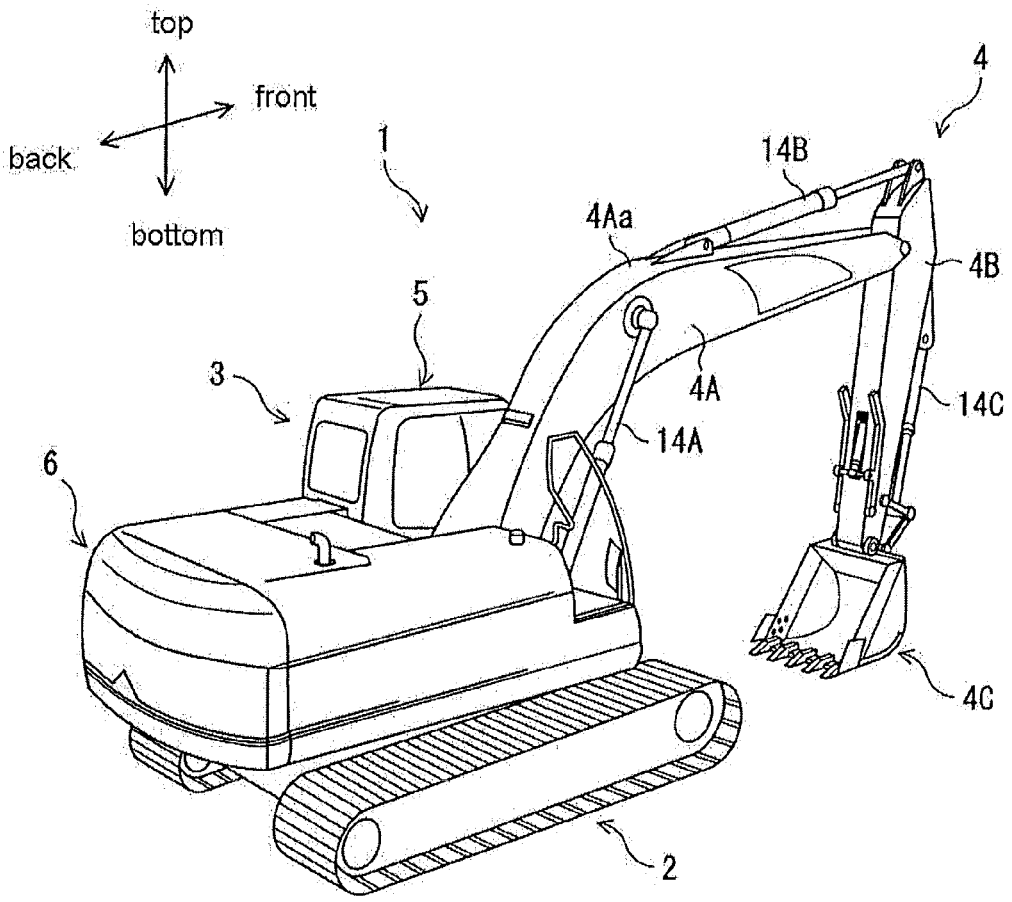
FIG. 1 is a schematic perspective view showing the entire configuration of a work machine according to an embodiment of the present invention.

FIG. 1 is a schematic perspective view showing the entire configuration of a work machine according to an embodiment of the present invention. This hydraulic shovel 1 is configured with a lower traveling body 2 equipped with a crawler-type traveling device, and an upper slewing body 3 mounted in a slewable manner on the lower traveling body 2. A cabin 5 for boarding an operator and a front work device (referred to as "work device," hereinafter) provided adjacent thereto are provided at the vehicle front side of the upper slewing body 3. A counterweight 6 for keeping the weight balance of the machine body is disposed at the rearmost end portion of the upper slewing body 3.

The work device 4 is configured with a boom 4A, a stick 4B, and a bucket 4C. The boom 4A has a curved portion 4Aa that protrudes upward at a longitudinal middle portion of the boom 4A in the posture shown in FIG. 1, and a boom foot boss 45 (see FIGS. 2(*a*) and 2(*b*)) provided at the base end portion of the boom 4A is axially supported so as to be able to swing freely with respect to the upper slewing body 3. Also, a boom cylinder 14A is interposed between the boom 4A and the upper slewing body 3, so the boom 4A swings in response to a telescopic motion of the boom cylinder 14A.

Similarly, the stick 4B has a base end portion thereof axially supported so as to be able to swing with respect to the end portion of the boom 4A, and the bucket 4C is axially supported by the end portion of the stick 4B. A stick cylinder 14B is interposed between the boom 4A and the stick 4B, and a bucket cylinder 14C is interposed between the stick 4B and the bucket 4C. The stick 4B and the bucket 4C swing in response to telescopic motions of the stick cylinder 14B and the bucket cylinder 14C.

Various input levers and pedals, not shown, which are used for inputting the actuation amount of each of these hydraulic devices, are provided inside the cabin 5.

The configuration of the boom according to the embodiment of the present invention is further described with reference to FIGS. 2(*a*) and 2(*b*).

Figure 2:
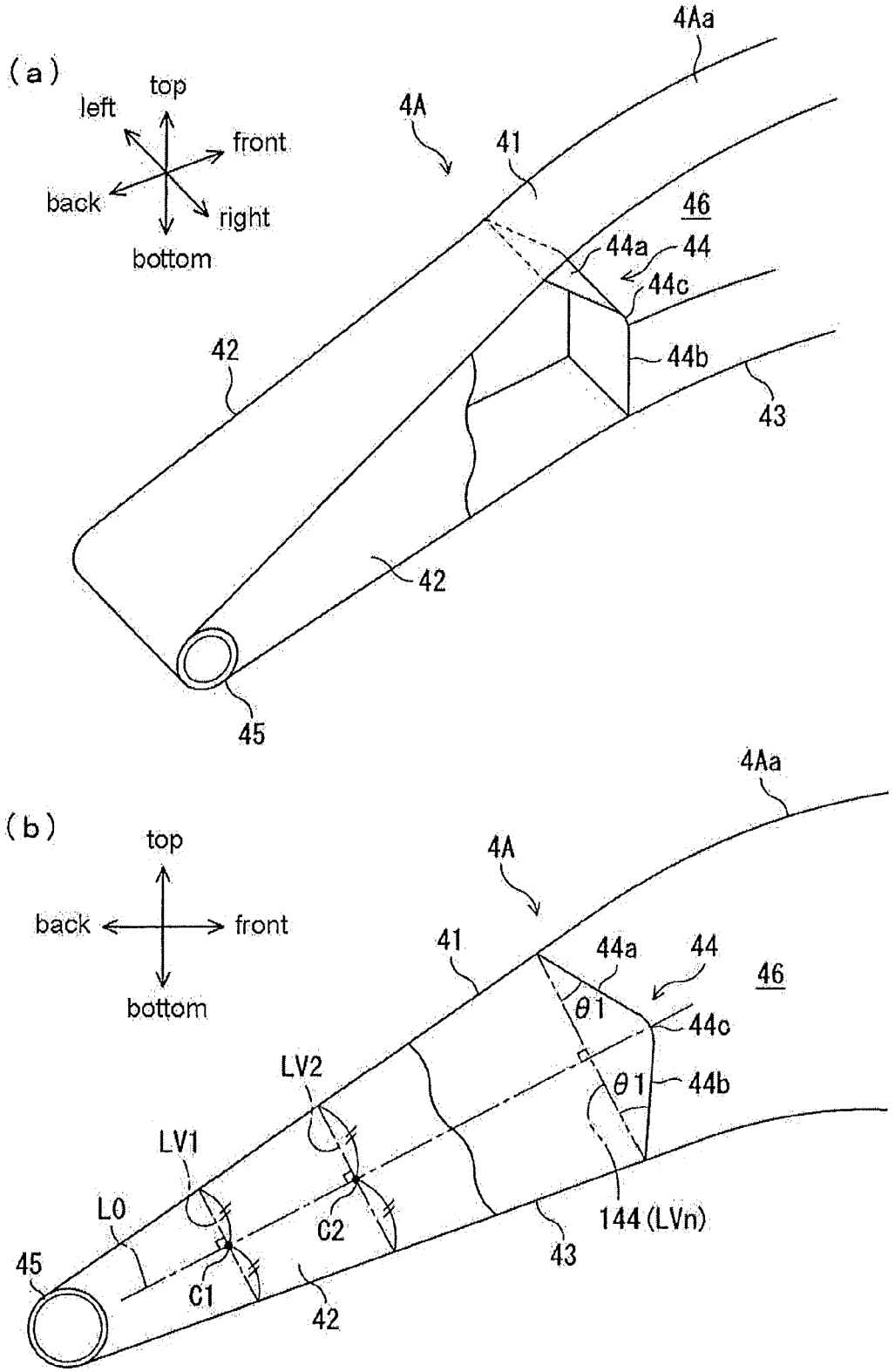
FIG. 2 is a schematic diagram showing the configuration of the rear portion of a boom according to the embodiment of the present invention, without the right side panel, wherein FIG. 2(*a*) is a perspective view in which the right-hand side of the configuration is viewed obliquely downward, and FIG. 2(*b*) a right-side view.

FIG. 2 is a schematic diagram showing the configuration of the rear portion of the boom according to the embodiment of the present invention, without the right side panel, wherein FIG. 2(*a*) is a perspective view in which the right-hand side of the configuration is viewed obliquely downward, and FIG. 2(*b*) a right-side view.

The boom 4A is configured with a top plate 41 configuring a ceiling surface, a pair of side plates 42 configuring side surfaces, and a bottom plate 43 configuring a bottom surface. Each side plate 42 is arched upward (toward the top plate 41) as a whole as viewed from the front, wherein the upper rim (the rim portion on the top plate 41 side) and the lower rim (the rim portion on the bottom plate 43 side) of each side plate 42 have the centers thereof in the extension direction curved upward. The top plate 41 is curved along the upper end of each side plate 42, and the side rims of the lower surface of the top plate 41 are welded to the upper ends of the side plates. The bottom plate 43 is curved along the lower end of each side plate 42, and the side rims of the upper surface of the bottom plate 43 are welded to the lower ends of the side plates 42.

An internal space 46 surrounded by the plates 41, 42, 43 is provided with a rear baffle 44 for reinforcement, which is located further on the rear side than the curved portion 4Aa. The rear baffle 44 is provided over the entire length of the boom 4A in the width direction in such a manner as to cut across the internal space 46 (precisely, in such a manner as to divide the internal space 46 into a front portion and a rear portion with respect to the longitudinal direction). The rear baffle 44 has an upper end thereof welded to the lower surface of the top plate 41, has a lower end of the same welded to the upper surface of the bottom plate 43, and has both left and right ends of the same welded to the inner side surfaces of the left and right side plates 42.

The rear baffle 44 is a plate curved vertically (in other words, bent into the opposite C shape as viewed from the right) and protruding forward. Specifically, the rear baffle 44 is a plate that has an upper inclined surface 44*a* inclining downward and forward and taking up approximately the upper half, a lower inclined surface 44*b* inclining downward and rearward and taking up approximately the lower half, and a curved portion 44*c* located in the middle in the vertical direction and connecting the upper inclined surface 44*a* and the lower inclined surface 44*b* to each other.

A conventional rear baffle 144 is shown with the two-dot chain line in FIG. 2(*b*). The conventional rear baffle 144 is a flat plate that is not curved and is installed in such a manner as to be divided perpendicularly into two sections by a centerline L0 of the side plates 42. The centerline L0 of the side plates 42 is defined as a line that has points C1, C2, etc. thereof dividing perpendicular lines LV1, LV2 of the centerline L0 into two sections between the top plate 41 and the bottom plate 43 (in other words, the centerline L0 is obtained by connecting these points C1, C2, etc.). Therefore, the rear baffle 144 can also be a perpendicular line LVn of the centerline L0.

In the rear baffle 44, the curved portion 44*c* disposed on the centerline L0, and each of the connecting positions between the top plate 41 and the bottom plate 43 is identical to that of the conventional baffle 144.

Specifically, the rear baffle 44 is curved on the centerline L0, has the upper end thereof connected to the intersection point between the top plate 41 and the perpendicular line LVn described above, and has the lower end of the same connected to the intersection point between the bottom plate 43 and the perpendicular line LVn. Therefore, the upper inclined surface 44*a* and the lower inclined surface 44*b* of the rear baffle 44 are equally inclined at an angle θ1 (30 degrees here) with respect to the conventional rear baffle 144.

In other words, when viewed from a side, the rear baffle 44 resembles the two equal sides of an isosceles triangle that are symmetrical with respect to the centerline L0.

Note that the internal space 46 is provided with a front baffle, not shown, at an area in front of the curved portion 4Aa (on the right-hand side of FIG. 2).

The reasons why the rear baffle 44 is formed into such a shape are described with reference to FIGS. 3(*a*), 3(*b*), 3(*c*) in addition to FIGS. 2(*a*) and 2(*b*).

Figure 3:
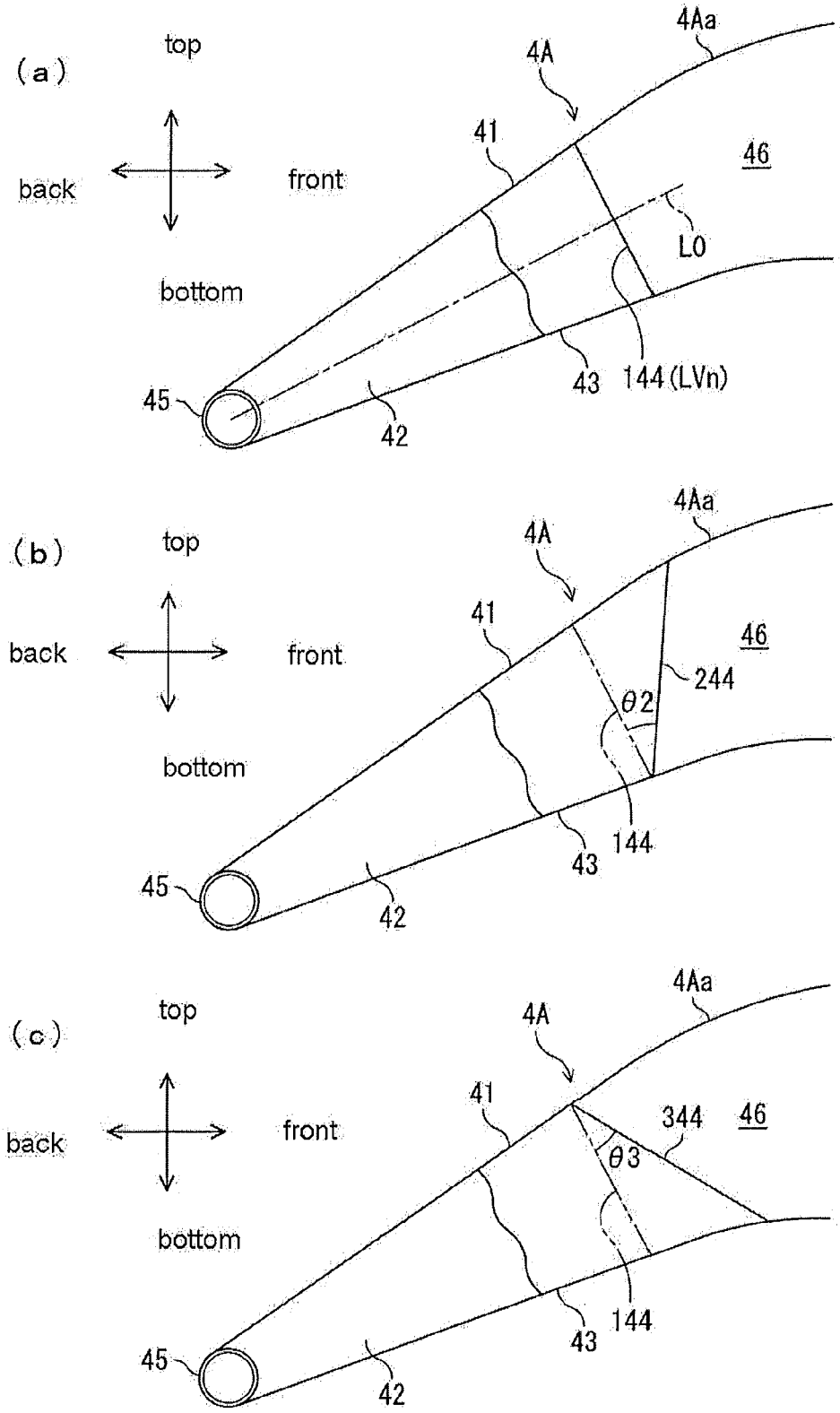
FIG. 3 is a schematic side view showing a reinforcement structure for the boom, without the right side panel, wherein FIG. 3(*a*) is a diagram showing a standard structure (conventional structure), FIG. 3(*b*) a diagram showing a comparative structure 1, and FIG. 3(*c*) a diagram showing a comparative structure 2.

FIG. 3 is a schematic side view showing a reinforcement structure for the boom, without the right side panel, wherein FIG. 3(*a*) is a diagram showing a standard structure, FIG. 3(*b*) a diagram showing a comparative structure 1, and FIG. 3(*c*) a diagram showing a comparative structure 2.

First, the standard structure, the comparative structure 1, and the comparative structure 2 are described. The standard structure is a conventional reinforcement structure configured as shown in FIG. 3(*a*) and using the conventional rear baffle 144. As described above, the rear baffle 144 is a flat plate without a curve and installed in such a manner as to be divided perpendicularly into two sections by the centerline L0 of the side plates 42.

As with the reinforcement structure for a boom according to the present invention, this rear baffle 144 is provided over the entire width of the boom 4A and has the entire circumference welded to the plates 41, 42, 43.

The comparative structure 1 and the comparative structure 2 are configured as shown in FIGS. 3(*b*) and 3(*c*). Rear baffles 244, 344 according to the comparative structures 1 and 2 are the same as the conventional rear baffle 144 shown with the two-dot chain line, in that the rear baffles 244, 344 are each a flat plate without a bent portion, provided over the entire width of the boom 4A, and each have the entire circumference welded to the plates 41, 42, 43, but are different from the rear baffle 144 in terms of the installation angle.

Specifically, in the comparative structure 1, the rear baffle 244 is the same as the conventional rear baffle 144 in terms of the positions thereof to be attached to the lower ends of the bottom plate 43, but is inclined forward at a predetermined angle θ2 (30 degrees here) from the conventional rear baffle 144, as shown in FIG. 3(*b*).

In the comparative structure 2, the rear baffle 344 is the same as the conventional rear baffle 144 in terms of the positions thereof attached to be attached to the upper ends of the top plate 41, but is inclined rearward at a predetermined angle θ3 (30 degrees here) from the conventional rear baffle 144, as shown in FIG. 3(*c*).

The strengths of these reinforcement structures were evaluated. As a result of analyzing the stresses caused in the top plate 41, the top side of each side plate 42 (near the top plate 41), the bottom side of each side plate 42 (near the bottom plate 43), and the bottom plate 43 surrounding each of the rear baffles 144, 244, 344, the results shown in Table 1 below were obtained.

In the standard structure (i.e., the conventional reinforcement structure), an excessive level of stress has occurred on the top side of each side plate 42. Therefore, for the top side of each side plate 42 in Table 1 below, "x" is entered on the assumption that there is a problem if the stress generated therein is equal to or greater than that of the standard structure, and "O" is entered on the assumption that there is an improvement if the stress generated therein is lower than that of the standard structure.

In the standard structure, on the other hand, the stresses that were generated in the sections other than the top side of each side plate 42, i.e., the top plate 41, the bottom side of each side plate 42, and the bottom plate 43, were comparatively small, posing no problems. Therefore, for the top plate 41, the bottom side of each side plate 42, and the bottom plate 43 in Table 1 below, "O" is entered on the assumption that there is no problem if the stresses generated therein are equal to or lower than those of the standard structure, and "x" is entered on the assumption that there is a problem if the stresses generated therein are significantly greater than those of the standard structure.

TABLE 1

| | | Stress generated on the rear side of each side plate | | |
|---|---|---|---|---|
| | Top plate | Top side | Bottom side | Bottom plate |
| Standard structure (conventional structure) | ○ | X | ○ | ○ |
| Comparative structure 1 | ○ | X | ○ (slightly reduced) | ○ (slightly reduced) |
| Comparative structure 2 | ○ | ○ | ○ | X (significant increase) |
| Present invention | ○ | ○ | ○ | ○ |

In the comparative structure 1, while a slight reduction in stress was confirmed in the bottom side of each side plate 42 and the bottom plate 43, a reduction in stress was not confirmed in the top side of each side plate 42, a problematic section.

In the comparative structure 2, a reduction in stress was confirmed in the top side of each side plate 42 which is a problematic section. However, a significant increase in stress was confirmed in the bottom plate 43, which is considered to make the application of this structure to an actual machine difficult.

In view of the results of the comparative structure 1 and the comparative structure 2, a configuration was suggested that employs, as the shape of the rear baffle, the forward inclination of the comparative structure 1 showing an improvement on the bottom side and the rearward inclination of the comparative structure 2 showing an improvement on the top side (i.e., the shape of the rear baffle 44 shown in FIGS. 2(*a*) and 2(*b*)). As a result of analyzing the stress generated in this structure, a reduction in stress was confirmed on the rear side (back) and the top side (upper portion) of each side plate 42 that are particularly problematic, i.e., in the rear upper portion of each side plate, as shown in the "Present invention" column of Table 1. In regard to the other sections as well, the stresses were maintained at the same levels (posing no problems) as the standard structure (conventional structure).

Therefore, the shape of the rear baffle according to the reinforcement structure of the present invention was employed as the shape of the rear baffle 44 shown in FIGS. 2(*a*) and 2(*b*).

The reasons why such a shape of the rear baffle can mitigate the concentration of stress (concentration of stress particularly in the rear upper portion of each side plate 42) are understood as follows.

As described above, when longitudinal bending, lateral bending, and twisting are made multiple times in the entire boom, high stress occurs in the boom. However, forming an angle in the rear baffle 44 can retain the function of preventing the twisting, which is the original function of the rear baffle 44, and at the same time dispersing the high stress can be understood to be able to mitigate the concentration of stress.

(1) According to the reinforcement structure for a boom of a work machine of an embodiment of the present invention, stress can be dispersed by simply configuring the rear baffle 44 with a plate curved vertically and protruding forward. Therefore, the plate thickness of the rear baffle 44 and the side plates 42 do not need to be increased, and concentration of stress in the rear upper portion of each side plate 42 can be prevented while preventing increases in weight and cost.

(2) The rear baffle 44 is curved on the centerline L0 of the side plates 42, has the upper end connected to the intersection point between the top plate 41 and the perpendicular line LVn of the centerline L0, and has the lower end connected to the intersection point between the bottom plate 43 and the perpendicular line LVn. Therefore, the rear baffle 44 is symmetrical with respect to the centerline L0, making it possible to attach the rear baffle 44 normally to the boom 4A even upside down. Consequently, the rear baffle 44 can be attached to the boom 4A without any regard to the top and the bottom.

In addition, the rear baffle 44 is in a vertically symmetrical, balanced shape, effectively preventing the stress from concentrating disproportionately.

(1) According to the foregoing embodiment, the single rear baffle 44 is provided over the entire width of the boom 4A. However, for instance, a plurality of relatively narrow rear baffles 44 may be arranged along the width direction, with a gap therebetween or stuck close to each other.

(2) According to the foregoing embodiment, the inclination angles of the upper inclined surface 44*a* and the lower inclined surface 44*b* of the rear baffle 44 are equal to each other, i.e., 30 degrees. However, these inclination angles can be changed as appropriate according to the occurrence of stress and manufacturability (of each model of work machine, for example). For example, the inclination angles of the upper inclined surface 44*a* and the lower inclined surface 44*b* do not have to be equal to each other (the inclination angle of the upper inclined surface 44*a* and the inclination angle of the lower inclined surface 44*b* may be different from each other). These inclination angles do not have to be 30 degrees. In other words, the inclination angles of the upper inclined surface 44*a* and the lower inclined surface 44*b* may be set at the same angle other than 30 degrees.

(3) According to the foregoing embodiment, the rear baffle 44 is symmetrical with respect to the centerline L0; however, the rear baffle 44 may be asymmetrical with respect to the centerline L0 in accordance with the occurrence of stress and manufacturability (of each model of work machine, for example).

Figure 4:
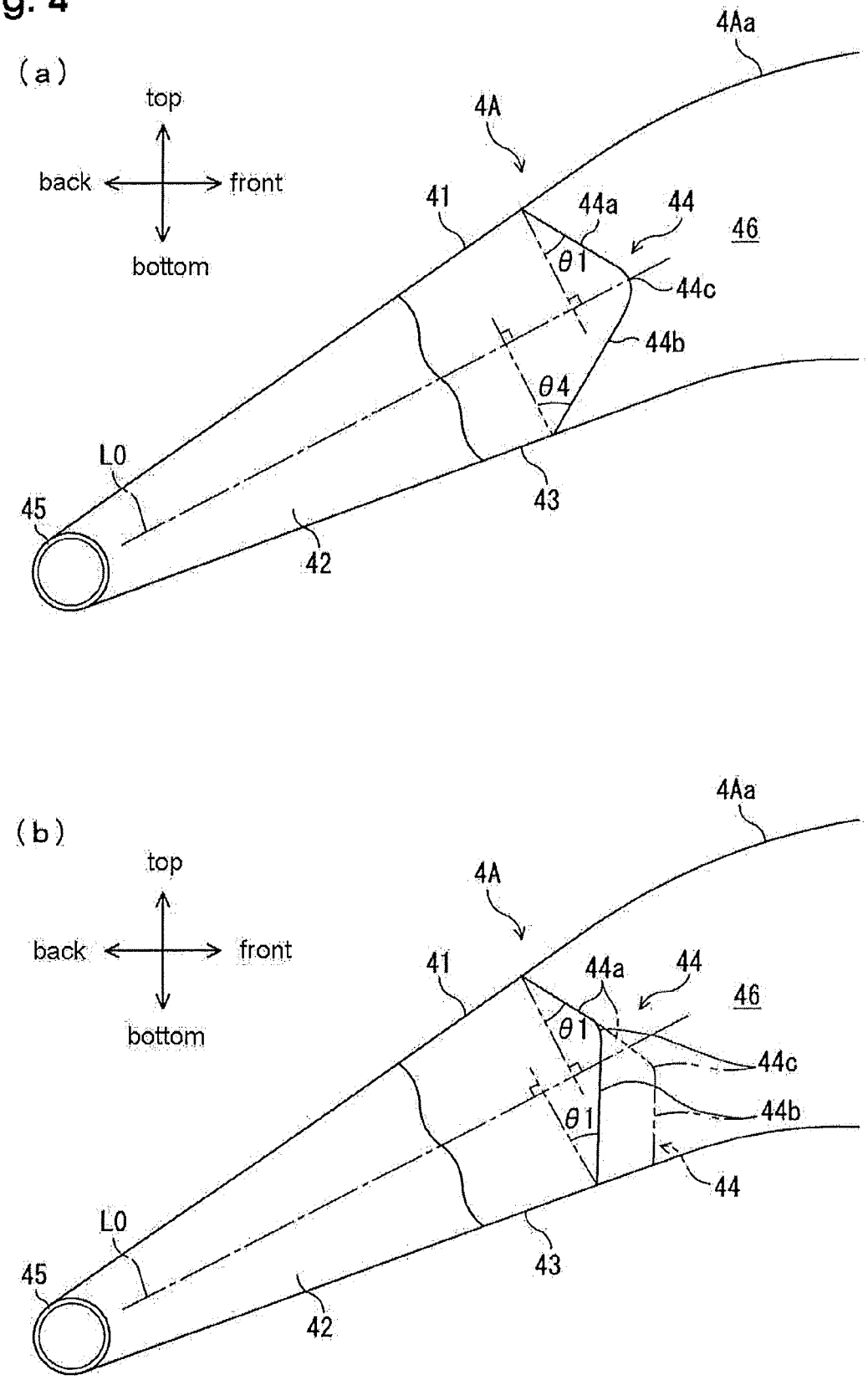
FIGS. 4(*a*) and 4(*b*) are each a schematic diagram showing the configuration of a rear portion of a boom according to a modification of the embodiment of the present invention, without the right side panel.

For example, as shown in FIG. 4(*a*), while having the rear baffle 44 curved on the centerline L0, the inclination angle of the upper inclined surface 44*a* and the inclination angle of the lower inclined surface 44*b* may be set at mutually different angles of θ1, θ4. Alternatively, as shown by the solid line or the two-dot chain line in FIG. 4(*b*), the inclination angle of the upper inclined surface 44*a* and the inclination angle of the lower inclined surface 44*b* may be the same angle of θ1, and the rear baffle 44 may be curved at a position away from the centerline L0 (the position of the curved portion 44*c* may be set at a position close to the top plate 41 or a position close to the bottom plate 43).

In addition, while having the rear baffle 44 curved at the position away from the centerline L0, the inclination angle of the upper inclined surface 44*a* and the inclination angle of the lower inclined surface 44*b* may be set at mutually different angles.

The invention claimed is:

1. A boom for a work machine, the boom comprising:

a top plate;

a bottom plate facing the top plate;

a pair of side plates spanning between and attached to the top plate and the bottom plate, the top plate, the bottom plate, and the pair of side plates defining an internal space therebetween;

a boom foot boss disposed at an end of the boom, and configured to pivotally attach the boom to a body of the work machine;

a curved portion defined by the top plate, the bottom plate, and the pair of side plates, and disposed in a middle of the boom along a longitudinal direction, the top plate including a top planar portion disposed between the curved portion and the boom foot boss along the longitudinal direction, the bottom plate including a bottom planar portion disposed between the curved portion and the boom foot boss along the longitudinal direction; and a baffle attached directly to the top planar portion and the bottom planar portion, and extending across the internal space between the pair of side plates, the baffle including an upper surface and a lower surface, the upper surface being inclined relative to the lower surface to define a convexity of the baffle, the convexity of the baffle pointing away from the boom foot boss along the longitudinal direction, the upper surface of the baffle being disposed between the lower surface of the baffle and the top planar portion along a vertical direction, the vertical direction being transverse to the longitudinal direction, the lower surface of the baffle being disposed between the upper surface of the baffle and the bottom planar portion along the vertical direction.

2. The boom according to claim 1, wherein the baffle is symmetrical with respect to a centerline of the side plates.

3. The boom according to claim 1, wherein the baffle further includes a curved portion disposed between the upper surface of the baffle and the lower surface of the baffle along the vertical direction.

4. The boom according to claim 3, wherein the curved portion of the baffle is located on a centerline of the side plates, the upper surface of the baffle is directly connected to the top plate, the lower surface of the baffle is directly connected to the bottom plate, the upper surface of the baffle forms a first angle with the centerline of the side plates, the lower surface of the baffle forms a second angle with the centerline of the side plates, and the first angle is equal to the second angle.

5. The boom according to claim 4, wherein the baffle is attached directly to each plate of the pair of side plates.

6. The boom according to claim 3, wherein the curved portion of the baffle is located on a centerline of the side plates, the upper surface of the baffle is directly connected to the top plate, the lower surface of the baffle is directly connected to the bottom plate, the upper surface of the baffle forms a first angle with the centerline of the side plates, the lower surface of the baffle forms a second angle with the centerline of the side plates, and the first angle is not equal to the second angle.

7. The boom according to claim 6, wherein the first angle is greater than the second angle.

8. The boom according to claim 6, wherein the baffle is attached directly to each plate of the pair of side plates.

9. The boom according to claim 3, wherein the upper surface of the baffle and the lower surface of the baffle form two sides of an isosceles triangle that are symmetrical with respect to a centerline of the side plates.

10. The boom according to claim 3, wherein the upper surface of the baffle is inclined toward the boom foot boss along the longitudinal direction as the upper surface of the baffle extends from the curved portion of the baffle toward the top plate along the vertical direction, and wherein the lower surface of the baffle is inclined toward the boom foot boss along the longitudinal direction as the lower surface of the baffle extends from the curved portion of the baffle toward the bottom plate along the vertical direction.

11. The boom according to claim 1, wherein the baffle is asymmetrical with respect to a centerline of the side plates.

12. The boom according to claim 11, wherein the upper surface of the baffle is inclined toward the boom foot boss along the longitudinal direction as the upper surface of the baffle extends from the curved portion of the baffle toward the top plate along the vertical direction, and wherein the lower surface of the baffle is inclined toward the boom foot boss along the longitudinal direction as the lower surface of the baffle extends from the curved portion of the baffle toward the bottom plate along the vertical direction.

13. The boom according to claim 11, wherein the baffle further includes a curved portion disposed between the upper surface of the baffle and the lower surface of the baffle along the vertical direction, and the curved portion of the baffle is not located on the centerline of the side plates.

14. The boom according to claim 1, wherein the baffle is attached directly to each plate of the pair of side plates.

* * * * *